US006488278B1

(12) United States Patent
Hansch

(10) Patent No.: US 6,488,278 B1
(45) Date of Patent: Dec. 3, 2002

(54) APPARATUS FOR FEEDING SHEET-LIKE ARTICLES TO A PROCESSING ARRANGEMENT

(75) Inventor: Egon Hansch, Wetzikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/558,571

(22) Filed: Apr. 26, 2000

(30) Foreign Application Priority Data

May 7, 1999 (CH) ..... 0862/99

(51) Int. Cl.[7] ..... B65H 5/12

(52) U.S. Cl. ..... 271/268; 271/277; 271/85; 271/204; 271/206

(58) Field of Search ..... 271/268, 277, 271/85, 82, 204, 206

(56) References Cited

U.S. PATENT DOCUMENTS 4,629,175 A * 12/1986 Fischer et al. ..... 271/82 X
4,981,291 A 1/1991 Honegger et al.
5,052,666 A 10/1991 Hansch
5,052,667 A 10/1991 Hansch
5,292,110 A 3/1994 Honegger
5,324,014 A 6/1994 Honegger et al.
5,350,167 A 9/1994 Hansch
5,425,837 A 6/1995 Hansch
5,636,832 A 6/1997 Honegger et al.
5,645,679 A 7/1997 Hansch

* cited by examiner

*Primary Examiner*—Joseph E. Valenza
*Assistant Examiner*—Richard Ridley
(74) *Attorney, Agent, or Firm*—Brinks Hofer Gilson & Lione

(57) ABSTRACT

The apparatus has a conveying arrangement (10) with clamps (12) which are arranged one behind the other and are driven along the circulatory path (18) in the direction of circulation (U). In the receiving section (16), the mouth (14) of the clamps (12) is directed in the direction of circulation (U) and intended for gripping at the trailing edge (22'), as seen in the direction of circulation (U), a sheet-like article (22) arranged on the bearing element (20). The bearing element (20) has two bearing rails (60, 62), the upstream bearing rail (60), as seen in the direction of circulation (U), being designed such that it can be pushed away by the clamps (12).

10 Claims, 3 Drawing Sheets

APPARATUS FOR FEEDING SHEET-LIKE ARTICLES TO A PROCESSING ARRANGEMENT

FIELD OF THE INVENTION

The present invention relates to an apparatus for feeding sheet-like articles to a processing arrangement.

BACKGROUND OF THE INVENTION

An apparatus of this type is known from EP-A-0 675 062 and the corresponding U.S. Pat. No. 5,645,679. It has a wheel-like conveying arrangement with clamps which are arranged one behind the other on the periphery and are driven along a circulatory path in the direction of circulation. These clamps can be controlled individually in terms of position and also in terms of opening and closing action. Two interacting clamping elements of a clamp form in each case one clamp mouth which, in a receiving section of the circulatory path, is oriented in the direction of circulation. Running in the radial direction in relation to the wheel-like conveying arrangement is a magazine shaft for a supply of articles arranged in a stack-like manner, such as credit cards, postcards, printed products, samples and the like. The discharge-side end of the magazine shaft is located adjacent to the receiving section of the circulatory path of the clamps, on the outer side thereof, as seen in the radial direction. A sucker arrangement with a suction head driven synchronously with the conveying arrangement is intended for gripping in each case the uppermost sheet-like article of the supply stack, on the exposed face thereof, and for lifting it off from the supply stack into the movement path of the clamps, with the result that by way of its clamp mouth, which is directed in the direction of circulation, in each case one clamp can grip the relevant article at its trailing edge in order to transport it further.

SUMMARY OF THE INVENTION

Taking this prior art as departure point, it is an object of the present invention to provide an apparatus of the generic type which, along with a straightforward construction, makes it possible to process a wide range of sheet-like articles.

The apparatus according to the invention has, in the receiving section, a bearing element for the article which is to be gripped by a clamp in each case. This makes it possible for the articles to be fed individually onto the bearing element from different directions. In particular, lateral feeding of the articles is made possible, as seen in the direction of circulation of the clamps. Since the articles are arranged on a bearing element in order to be received by the clamps, that side of said articles which is directed away from the bearing element is exposed. This makes it possible, for example, to process articles which are already provided with adhesive on the side which is exposed in relation to the bearing element. Since the bearing element is designed to have a yielding capacity, it is possible to dispense with driven elements for introducing the articles into the clamps. There is no need for any dedicated drive for the bearing element.

BRIEF DESCRIPTION OF THE DRAWINGS

The present invention will be explained in more detail with reference to two embodiments illustrated in the drawing, in which, purely schematically.

DESCRIPTION OF THE PREFERRED EMBODIMENT

Figure 1:
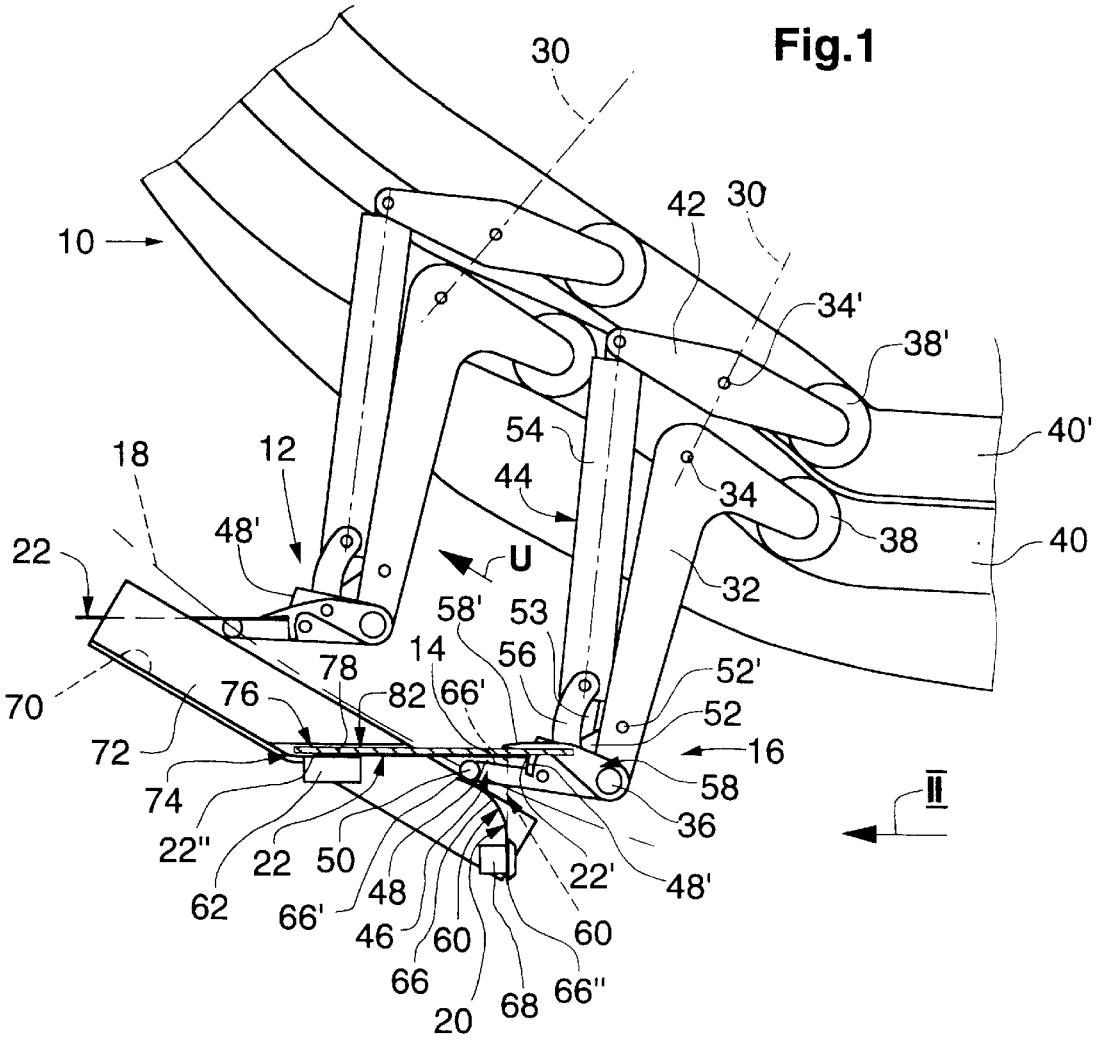
FIG. 1 shows a view of part of the apparatus in the region of the receiving section with a bearing element arranged there for the articles which are to be gripped by clamps.

With regard to the construction and functioning of the conveying arrangement 10, part of which is shown in the drawing, attention is invited to U.S. Pat. No. 5,645,679, the contents of which are incorporated by reference. This conveying arrangement has controllable clamps 12 which are intended to grip by way of their mouth 14, in a receiving section 16 of their circulatory path 18, in each case one sheet-like article 22 arranged on a bearing element 20, and to transport said article in the direction of circulation U to a transfer region 24—see FIGS. 4 and 5—where the article 22 is positioned, in a processing arrangement 26 for printed products 28, on a printed product.

Carrier-like circulatory elements 30 project, in a uniformly distributed manner in the direction of circulation, from a circular carrying disk, which is driven continuously in the direction of circulation U about its axis of rotation, in each case one carrying arm 32 being mounted on said circulatory elements such that it can be pivoted about an articulation spindle 34 parallel to the axis of rotation of the carrying disk. At its radially outer end, the carrying arm 32 bears a clamp 12 which can be pivoted about a pivot spindle 36 which is parallel to the articulation spindle 34. The carrying arm 32 is designed as a two-armed angle lever which has mounted, at its end which is directed away from the clamp 12, a follow-on roller 38 which is guided in a first guide path 40 running around the carrying disk. When the circulatory elements 30 circulate along their circular circulatory path, the carrying arm 32 is pivoted about its articulation spindle 34, by means of said guide path 40, in and counter to the direction of circulation U.

A two-armed control lever 42 is mounted on each circulatory element 30, on a further articulation spindle 34', which is parallel to the articulation spindle 34 and is arranged further inward in the radial direction in relation thereto, said control lever likewise being connected to the clamp 12 by a connecting rod 44. A further follow-on roller 38' is mounted rotatably on the control lever, at that end of the latter which is directed away from the connecting rod 44, and said further follow-on roller is guided in a further guide path 40', which likewise runs around the carrying disk. During the circulation of the circulatory elements 30, said further guide path 40' controls the pivot position of the clamps 12 and opens and closes the mouth 14 of the clamps 12.

A first clamping part 46 of the clamp 12 is mounted on the pivot spindle 36, and said clamping part has formed on it a bearing surface 48 and, at the end thereof which is located closer to the pivot spindle 36, a stop surface 48'. A pressure-exerting roller 50 is mounted in a fully rotatable manner at the free end of the first clamping part 46. Connected fixedly to the first clamping part 46 is a triangular stop part 52 which is likewise mounted on the pivot spindle 36 and is intended for interacting with a stop pin 52' on the carrying arm 32 in order to open the clamp mouth 14. Furthermore, a tie rod 53 is articulated on the stop part 52, and this tie rod extends into the interior of a sleeve 54 of the connecting rod 44, said sleeve being articulated on the control lever 42, and is subjected there to the action of a compression spring which, at the other end, is supported at that end of the sleeve 54 which is directed toward the clamp 12. Articulated on the sleeve 54 is a link plate 56 which is connected to a second clamping part 58, which has two clamping arms 58' and is likewise mounted pivotably on the pivot spindle 36. The clamping arms 58' project beyond the stop surface 48' and, together with the bearing surface 48 of the first clamping part 46, form the clamp mouth 14, which is bounded by the stop surface 48', which runs at right angles to the direction of circulation U.

Prior to movement into the receiving section 16, the carrying arm 32 and the control lever 42 are displaced into a pivot position in which the bearing surface 48 of the first clamping part 46, with the stop part 52 butting against the stop pin 52', is arranged approximately in the horizontal direction and the clamp mouth 14, which is directed approximately in the direction of circulation U, is opened by virtue of the clamping arms 58' being lifted off from the bearing surface 48. The first clamping part 46 then passes beneath the article 22 located on the bearing element 20, the clamping arms 58' coming to rest above said article 22. The stop surface 48' comes into abutment against the trailing edge 22' of the article 22, as seen in the direction of circulation U, as a result of which said article is carried along in the direction of circulation U. The clamp mouth 14 is then closed by virtue of the control lever 42 being pivoted.

Figure 2:
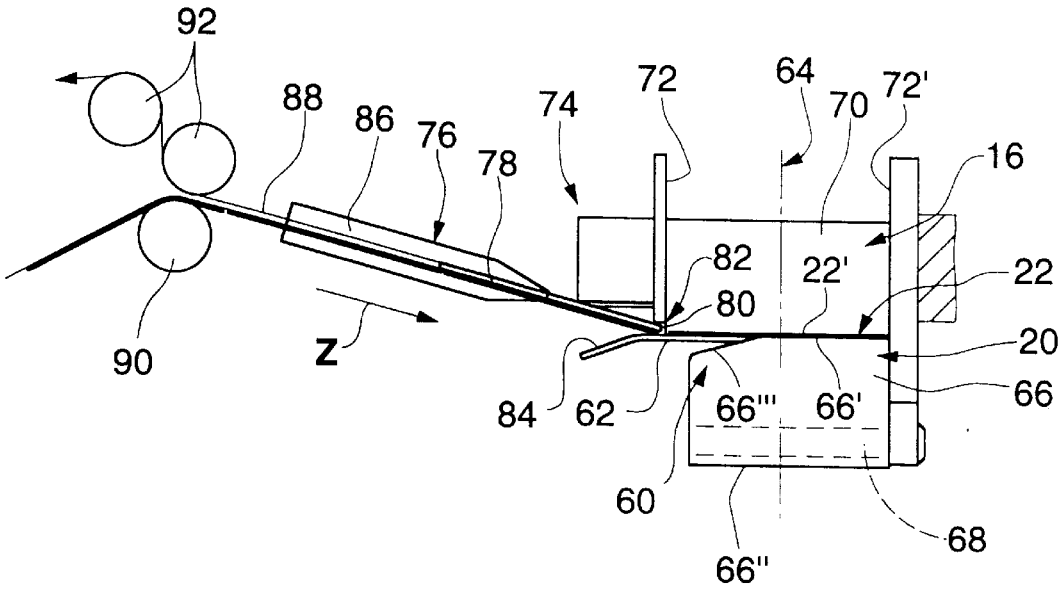
FIG. 2 shows, in the direction of the arrow 11 from FIG. 1, the bearing element and a feed conveyor for successively feeding sheet-like articles onto the bearing element.
Figure 3:
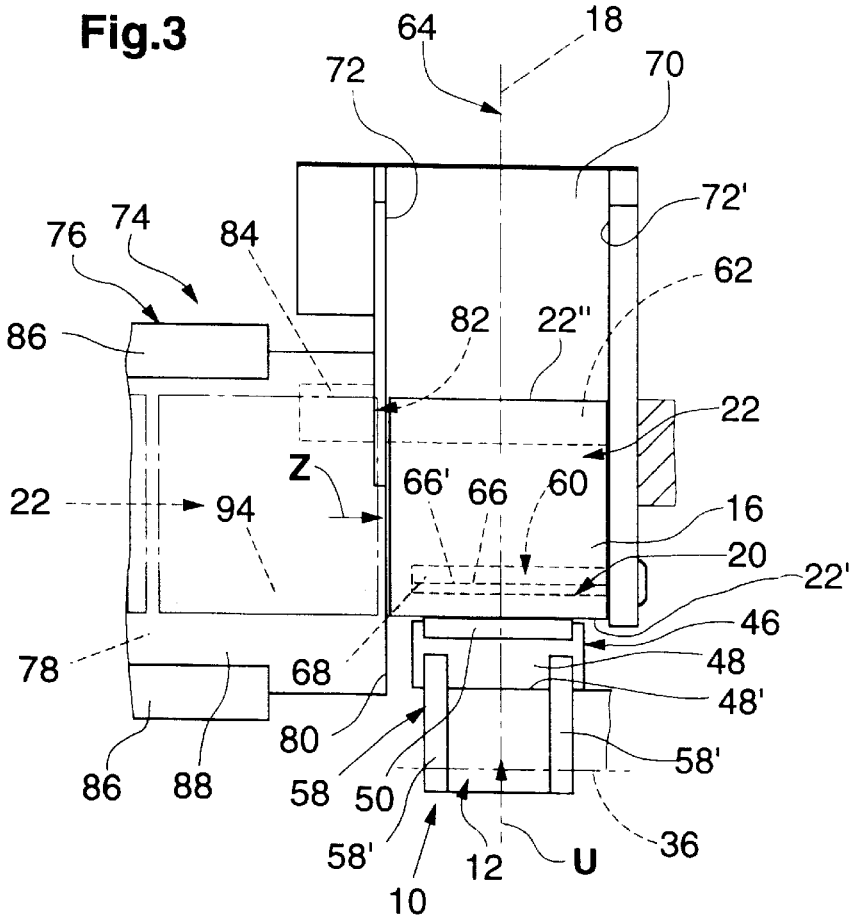
FIG. 3 shows a plan view of the bearing element shown in FIGS. 1 and 2, with part of the feed conveyor.

In the case of the embodiment shown in FIGS. 1 to 3, the bearing element 20 has two bearing rails 60, 62 which run at right angles to a plane 64 in which the receiving section 16 of the circulatory path 18 runs and which is arranged at right angles to the clamp mouth 14 and the bearing surface 48 of the first clamping part 46. The second bearing rail 62, which is formed for example from a metal sheet, is arranged downstream of the first bearing rail 60, as seen in the direction of circulation U. The first bearing rail 60 is formed by a sheet-like, approximately rectangular flexible plastic element 66 which runs in a vertical direction in the rest position, and of which the top edge 66', which runs parallel to the second bearing rail 62, forms the rest for the article 22, and which is fastened on a rectangular profile bar 68 along its bottom edge 66". As can be seen, in particular, from FIG. 1, the circulatory path 18 of the free end of the first clamping part 46, said free end being formed by the pressure-exerting roller 50, runs through the plastic element 66 located in the rest position; the circulatory path 18 thus crosses over the bearing element 20. It can also be seen from FIG. 1 that the article 22 resting on the bearing rails 60, 62 has a border region projecting beyond the first bearing rail 60 counter to the direction of circulation U. As it grips beneath the article 22, the first clamping part 46 bends away the plastic element 66, which is designed to have a yielding capacity, out of its movement region by means of the pressure-exerting roller 50, whereupon the article, which is still resting on the second bearing rail 62, comes into abutment against the bearing surface 48 of the first clamping part 46. As has been described above, said article 22 is carried along by the stop surface 48' and, secured by the clamp mouth 14 by virtue of the latter being closed, transported further. As soon as the relevant transporting clamp 12 has run off the plastic element 66, which has inherently resilient properties, said plastic element automatically rights itself again into the vertical, rest position, which is indicated by dashed lines in FIG. 1.

The second bearing rail 62 is adjoined downstream, as seen in the direction of circulation U, by a guide surface 70, which encloses an obtuse angle with the bearing element 20. As soon as a clamp 12 carries along in the direction of circulation U, by way of its open mouth 14, an article 22 resting on the bearing element 20, the article 22 comes into abutment, by way of its leading edge 22", against the guide surface 70 and is guided with sliding action thereon. The friction between the guide surface 70 and the article 22 results in the latter remaining in abutment against the stop surface 48' until the clamp mouth 14 has closed even with a high circulatory speed of the clamps 12.

In this case, the article 22 is stabilized against rotation laterally, as seen in the direction of circulation U, by side walls 72, 72'. The guide surface 70 and the side walls 72, 72' form something of a guide channel for the articles 22.

The feed arrangement 74 for the articles 22 has a feed conveyor 76, of which the feed direction is designated by Z. One component of this feed direction Z runs at right angles to the plane 64, and thus in the longitudinal direction of the bearing rails 60, 62, and the other component runs in the direction from top to bottom. The articles 22 are thus fed to the bearing element 20, and pushed onto the same, transversely to the direction of circulation U and with a slight gradient.

The feed conveyor 76 has a guide plate 78 which is rectangular in plan view (FIG. 3) and of which the detachment edge 80 is arranged in a feed gap 82 in the side wall 72, which is located closer to the feed arrangement 74. Said feed gap 82 is bounded on the underside by the second bearing rail 62, which has a run-on tongue 84 projecting beyond the side wall 72 in the direction toward the feed conveyor 76. At a distance from the side wall 72, the guide plate 78 has in each case one U-shaped guide profile 86 engaging around it laterally, as seen in the feed direction Z. A carrier band 86, which comes, for example, from a supply reel (not shown), is guided over a deflecting roller 90 and runs from there, beneath the guide plate 78, into a gap, bounded by the latter and the guide profiles 86, to the detachment edge 80. At this location, it is guided around said detachment edge 80 and runs from there on the top side of the guide plate 78, in turn, into a gap, bounded by the latter and the guide profiles 86, to a roller pair 92 which can be driven in start/stop operation and around which the carrier band is guided in the form of an S. The articles 22, in the present case rectangular paper notes, are fastened at intervals one behind the other on the carrier band 88 by way of an application of adhesive 94 which is provided on said paper notes in a strip-like manner. This strip-like application of adhesive 94 runs in the feed direction Z and along the upstream, trailing edge 22', as seen in the direction of circulation U.

If the carrier band 88 is drawn in the arrow direction by means of the roller pair 92, in each case one article 22 detaches itself gradually from the carrier band 88 at the detachment edge 80, and is simultaneously pushed onto the bearing rails 60, 62 in the process. The application of adhesive 94, which remains on the article 22, is then exposed on the top side of the article, which is resting on the bearing element 20.

As can be seen, in particular from FIG. 3, the run-on tongue 84 ensures that the articles 22 are also guided through the feed gap 82 onto the second bearing rail 62 by way of their region which is not adhesively bonded on the carrier band 88. Furthermore, as can be seen from FIG. 2, the plastic element 66 has in its top corner region directed toward the feed conveyor 76, a bevel 66''' which serves for guiding the article 22 onto the rest-forming top edge 66'. The side wall 72', which is further away from the feed arrangement 74, serves, during the feed operation of the articles 22, as a stop for the edge of the latter which leads in the feed direction Z and is located laterally in the direction of circulation U.

For the sake of completeness, it should be mentioned that both the profile bar 68 and the metal sheet which forms the guide surface 70 and the second bearing rail 62 are fastened on said side wall 72', which is fastened on a machine framework.

Figure 4:
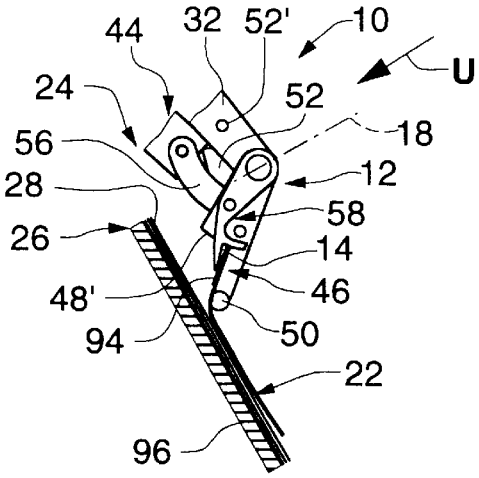
FIG. 4 shows an article-retaining clamp as it positions the article on a printed product in a processing arrangement.
Figure 5:
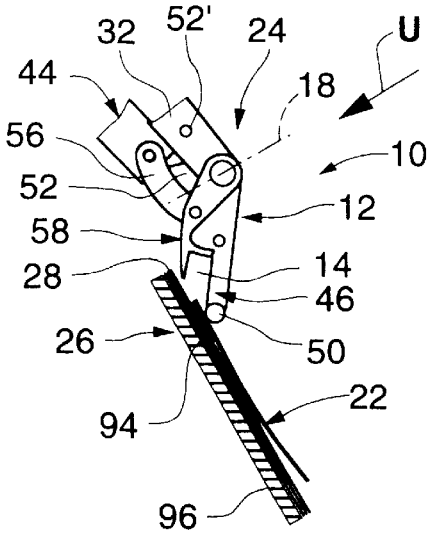
FIG. 5 shows, in the same illustration as FIG. 4, the same clamp once it has released the article and pressed onto the printed product the border portion provided with adhesive.

As can be seen from FIG. 1, the receiving section 16 is located more or less at the 7 o'clock position of the conveying arrangement 10. Located at approximately the 4 o'clock position is the processing arrangement 26, of which, for the sake of clarity, FIGS. 4 and 5 show just one wall element 96 with a multi-part printed product 28 butting against it. Examples of such processing arrangements are disclosed in EP-A-0 550 828; 0 510 525; 0 341 425; 0 341 424; 0 341 423 and the corresponding U.S. Pat. Nos. 5,324,014; 5,292,110; 5,052,667; 5,052,666; 4,981,291.

The apparatus shown in FIGS. 1 to 5 functions as follows. The situation shown in FIGS. 1, 2 and 3 will be taken as the starting point. An article 22 rests on the bearing element 20. The corresponding clamp 12, as has been described above, engages beneath the article 22, pushing away the first bearing rail 60 at the same time, and grips said article at the trailing edge 22' by virtue of the mouth 14 being closed. As soon as said clamp 20 has lifted the article 22 off from the bearing element 20 and the clamp 12 has run off the first bearing rail 60, the roller pair 92 is activated until a new article 22 has been pushed onto the first and second bearing rails 60, 62 and butts in an aligned manner against the side wall 72' by way of the corresponding edge. This article 22 is then ready to be gripped by the next-following open clamp 12.

In the transfer region 24, as has been described in detail in U.S. Pat. No. 5,645,679, the clamp 12 positions the article 22 retained by it on the exposed side of the printed product 28 butting against the wall element 96, as FIG. 4 shows. In this case, the pressure-exerting roller 50 is displaced back as a result of the relative movement between the clamp 12 and the wall element 96, and this results in the clamp mouth 14 opening and thus in the article 22 being released. The pressure-exerting roller 50 is then drawn over the article 22 in order to press the region with the application of adhesive 94 onto the printed product 28.

Figure 6:
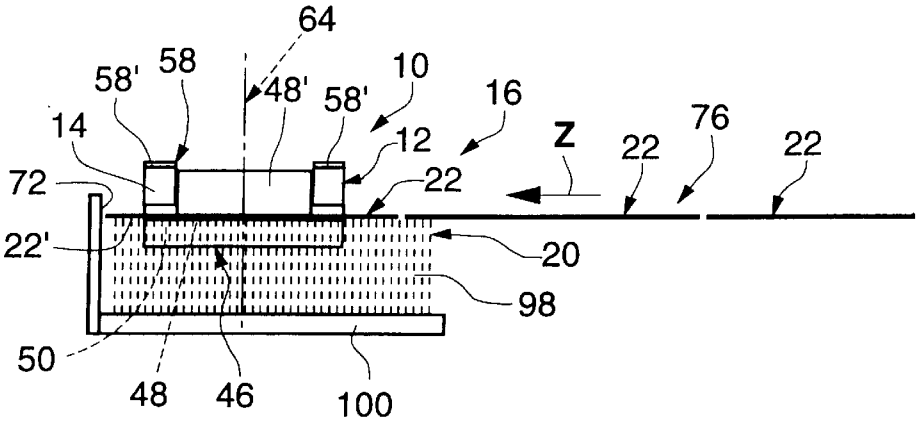
FIG. 6 shows, in a side view in the direction counter to the arrow 11 in FIG. 1, a clamp as it grips an article arranged on a brush-like bearing element.
Figure 7:
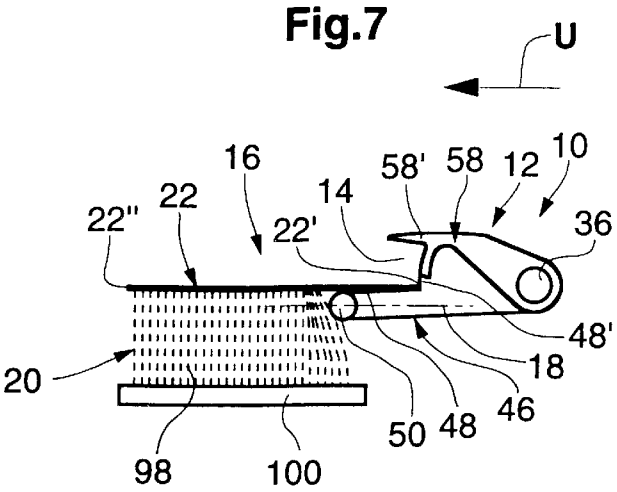
FIG. 7 shows the embodiment shown in FIG. 6, as seen in the feed direction Z.
Figure 8:
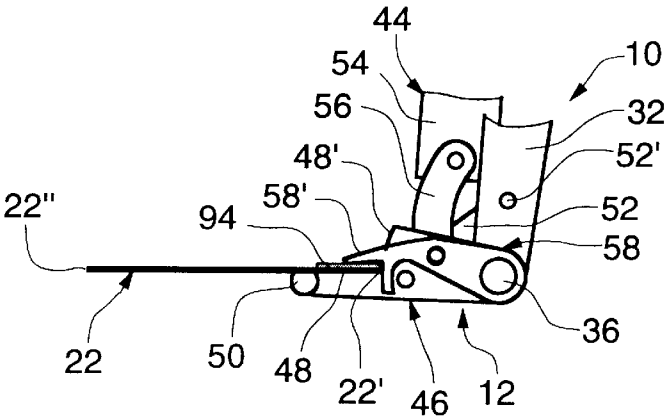
FIG. 8 shows a clamp retaining an article with a strip-like application of adhesive.

In the case of the embodiment shown in FIGS. 6 to 8, the bearing element 20 is formed by an area of bristles 98. The bristles are fastened on a planar bristle carrier 100 in the manner of a brush. As FIG. 7 shows, it is also the case here that the article 22 arranged on the area of bristles has a section which adjoins the trailing edge 22' projecting beyond the area of bristles 98 counter to the direction of circulation U of the clamps 12. With the mouth 14 open, the first clamping part 46 engages beneath the article 22 and then uses its free end to displace the bristles which are in the way. As soon as the stop surface 48' comes into abutment against the trailing edge 22', the article 22 is carried along in the direction of circulation U and, once the clamp mouth 14 has been closed, the article 22, retained by the clamp 12, is lifted off from the area of bristles 98 and transported to the transfer region 24.

The feed conveyor 76 may be designed in the same way as has been described above and shown in FIGS. 2 and 3. This is indicated schematically in FIG. 6 with articles 22 arranged one behind the other. In this case, the guide plate 78 is preferably arranged parallel to the bearing surface, which is defined by the area of bristles 98. Arranged on the downstream side of the area of bristles 98, as seen in the feed direction Z, is a side wall 72 which serves as a stop for the articles 22 when they are fed onto the bearing element 20 and as a lateral guide when they are gripped by the clamps 12. FIG. 6 shows the clamp 12 with the first clamping part 46 with the pressure-exerting roller 50 and the stop surface 48', and with the second clamping part 58 with the two clamping arms 58'. Since these clamping arms, as can also be seen from FIG. 8, have only a small surface area which comes into contact with the adhesive 94 on the article 22, and the clamping arms 58' are preferably produced from a material to which the adhesive 94 adheres badly, if at all, this ensures that the article 22 is released when the mouth 14 is opened.

It is also the case in the embodiment shown in FIGS. 6 to 8 that the movement path 18 of the first clamping part 46 of the clamps 12 crosses over the area of bristles 98, which forms the bearing element 20. The flexible bristles are designed to have a yielding capacity and the clamp 12 passes over them.

The articles 22 may be notes which are known by the tradename "Post-It." However, the apparatus is also suitable for processing different sheet-like articles, such as credit cards, postcards, printed products having one or more sheets, samples and the like. It is possible to process, in particular, flexible, sheet-like articles.

The articles may have the application of adhesive at different locations; in particular, more than one region may be provided with adhesive. Thus, the apparatus shown in the figures is also suitable, in particular, for processing articles which have an, if appropriate, strip-like application of adhesive along the leading edge and along the trailing edge. Of course, it is also possible to process articles which do not have any application of adhesive. In this case, it is possible for adhesive to be applied to the articles during the transportation by means of the clamps.

The bearing element may be designed differently, for example as a swing-action element or a resiliently mounted bar.

It is also possible for the feed conveyor to be of a different construction. It is thus conceivable for the individual articles to be pushed onto the bearing element via a sliding surface by means of a push rod, or for the articles to be border portions which are pushed onto the bearing element by virtue of the border being advanced and are then separated from the border.

It is possible to use suitable clamps of different, generally known construction. Of course, the circulatory path of the clamps may follow a course other than the more-or-less circular shape. The transfer region may be provided at a desired, suitable location downstream of the receiving section.

What is claimed is:

1. An apparatus for transporting sheet-like articles to a processing arrangement, comprising:

a conveying arrangement with individually controllable clamps which are arranged one behind the other, are driven along a circulatory path in the direction of circulation and each have two clamping elements which form a clamp mouth, said clamp mouth being oriented at least approximately in the direction of circulation when it is in a receiving section of the circulatory path, is oriented substantially in the direction of circulation; and a feed arrangement for feeding in each case one article into the receiving section, the clamps being intended for gripping, in the receiving section, in each case one article at its trailing edge, as seen in the direction of circulation, and then feeding said article to the processing arrangement;

wherein the feed arrangement has a feed conveyor that is arranged for conveying articles, one after the other, to be gripped in each case by a clamp, said conveyor running in a feed direction which is transverse to a plane in which the receiving section of the circulatory path runs, said plane also running at right angles to a clamp mouth plane defined by said one of the clamping elements;

wherein the feed arrangement, in the receiving section, has a bearing element for the article over which the circulatory path of one of the clamping elements crosses and directly engages said bearing element, said bearing element being yieldable in the direction of movement of said one of the clamping elements when said one clamping element directly engages and displaces the bearing element as it crosses over said bearing element so that an article on the bearing element may be gripped by a clamp in each case; and said bearing element having two bearing rails which are spaced apart from one another in the direction of circulation and of which the upstream bearing rail, as seen in the direction of circulation, has a yielding capacity.

2. An apparatus for transporting sheet-like articles to a processing arrangement, comprising:

a conveying arrangement with individually controllable clamps which are arranged one behind the other, are driven along a circulatory path in the direction of circulation and each have two clamping elements which form a clamp mouth, said clamp mouth being oriented at least approximately in the directing of circulation when it is in a receiving section of the circulatory path, is oriented substantially in the direction of circulation; and a feed arrangement for feeding in each case one article into the receiving section, the clamps being intended for gripping, in the receiving section, in each case one article at its trailing edge, as seen in the direction of circulation, and then feeding said article to the processing arrangement;

wherein the feed arrangement has a feed conveyor that is arranged for conveying articles, one after the other, to be gripped in each case by a clamp, said conveyor running in a feed direction which is transverse to a plane in which the receiving section of the circulatory path runs, said plane also running at right angles to a clamp mouth plane defined by said one of the clamping elements; and wherein the feed arrangement, in the receiving section, has a bearing element for the article over which the circulatory path of one of the clamping elements crosses, said bearing element being yieldable in the direction of movement of said one of the clamping elements as it crosses over said bearing element so that an article on the bearing element may be gripped by a clamp in each case; and said bearing element having two bearing rails which are spaced apart from one another in the direction of circulation and of which the upstream bearing rail, as seen in the direction of circulation, has a yielding capacity.

3. The apparatus as claimed in claims 1 or 2, wherein the bearing rails are arranged at right angles to the plane.

4. The apparatus as claimed in claim 3, wherein the bearing element has two bearing rails which are spaced apart from one another in the direction of circulation and of which the upstream bearing rail, as seen in the direction of circulation, has a yielding capacity.

5. An apparatus for transporting sheet-like articles to a processing arrangement, comprising:

a conveying arrangement with individually controllable clamps which are arranged one behind the other, are driven along a circulatory path in the direction of circulation and each have two clamping elements which form a clamp mouth, said clamp mouth being oriented at least approximately in the direction of circulation when it is in a receiving section of the circulatory path, is oriented at least more-or-less in the direction of circulation; and a feed arrangement for feeding in each case one article into the receiving section, the clamps being intended for gripping, in the receiving section, in each case one article at its trailing edge, as seen in the direction of circulation, and then feeding said article to the processing arrangement;

wherein the feed arrangement has a feed conveyor that is arranged for conveying articles, one after the other, to be gripped in each case by a clamp, said conveyor running in a feed direction which is transverse to a plane in which the receiving section of the circulatory path runs, said plane also running at right angles to a clamp mouth plane defined by said one of the clamping elements; and wherein the feed arrangement, in the receiving section, has a bearing element for the article comprising an area of bristles over which the circulatory path of one of the clamping elements crosses and directly engages said bearing element, said bearing element being yieldable in the direction of movement of said one of the clamping elements as it crosses over said bearing element so that an article on the bearing element may be gripped by a clamp in each case.

6. An apparatus for transporting sheet-like articles to a processing arrangement, comprising:

a conveying arrangement with individually controllable clamps which are arranged one behind the other, are driven along a circulatory path in the direction of circulation and each have two clamping elements which form a clamp mouth, said clamp mouth being oriented at least approximately in the direction of circulation when it is in a receiving section of the circulatory path, is oriented at least more-or-less in the direction of circulation; and a feed arrangement for feeding in each case one article into the receiving section, the clamps being intended for gripping, in the receiving section, in each case one article at its trailing edge, as seen in the direction of circulation, and then feeding said article to the processing arrangement;

wherein the feed arrangement has a feed conveyor that is arranged for conveying articles, one after the other, to be gripped in each case by a clamp, said conveyor running in a feed direction which is transverse to a plane in which the receiving section of the circulatory path runs, said plane also running at right angles to a clamp mouth plane defined by said one of the clamping elements; and wherein the feed arrangement, in the receiving section, has a bearing element for the article comprising an area of bristles over which the circulatory path of one of the clamping elements crosses, said bearing element being yieldable in the direction of movement of said one of the clamping elements as it crosses over said bearing element so that an article on the bearing element may be gripped by a clamp in each case.

7. An apparatus for transporting sheet-like articles to a processing arrangement, comprising:

a conveying arrangement with individually controllable clamps which are arranged one behind the other, are driven along a circulatory path in the direction of circulation and each have two clamping elements which form a clamp mouth, said clamp mouth being oriented at least approximately in the directing of circulation when it is in a receiving section of the circulatory path, is oriented at least more-or-less in the direction of circulation; and a feed arrangement for feeding in each case one article into the receiving section, the clamps being intended for gripping, in the receiving section, in each case one article at its trailing edge, as seen in the direction of circulation, and then feeding said article to the processing arrangement;

wherein the feed arrangement, in the receiving section, has a bearing element for the article over which the circulatory path of one of the clamping elements crosses and directly engages said beaming element, said bearing element being yieldable in the direction of movement of said one of the clamping elements as it crosses over said bearing element so that an article on the bearing element may be gripped by a clamp in each case; and a guide surface arranged downstream of the bearing element, as seen in the direction of circulation, and enclosing an obtuse angle therewith, said guide surface being intended for the leading edge, as seen in the direction of circulation, of the product gripped by a clamp.

8. An apparatus for transporting sheet-like articles to a processing arrangement, comprising:

a conveying arrangement with individually controllable clamps which are arranged one behind the other, are driven along a circulatory path in the direction of circulation and each have two clamping elements which form a clamp mouth, said clamp mouth being oriented at least approximately in the direction of circulation when it is in a receiving section of the circulatory path; and a feed arrangement for feeding in each case one article into the receiving section, the clamps being intended for gripping, in the receiving section, in each case one article at its trailing edge, as seen in the direction of circulation, and then feeding said article to the processing arrangement;

wherein the feed arrangement, in the receiving section, has a bearing element for the article over which the circulatory path of one of the clamping elements crosses, said bearing element being yieldable in the direction of movement of said one of the clamping elements as it crosses over said bearing element so that an article on the bearing element may be gripped by a clamp in each case; and a guide surface arranged downstream of the bearing element, as seen in the direction of circulation, and enclosing an obtuse angle therewith, said guide surface being intended for the leading edge, as seen in the direction of circulation, of the product gripped by a clamp.

9. The apparatus as claimed in claims 6 or 7, which comprises at least one side wall which runs in the direction of circulation, is arranged to the side of the bearing element and serves for guiding the articles which are to be gripped by the clamps and, if appropriate, as a stop for the article conveyed onto the bearing element by means of the feed conveyor.

10. The apparatus as claimed in claim 9, wherein the feed arrangement has a feed conveyor which opens out onto the bearing element from the side of the circulatory path of the clamps and is adapted for conveying onto the bearing element one after the other articles arranged one behind the other on a carrier band by means of adhesive, said articles being detached from the carrier band in the process.

* * * * *